United States Patent [19]

Gays et al.

[11] 4,043,349

[45] Aug. 23, 1977

[54] REMOVABLE CRIB CANOPY

[76] Inventors: Susan Gays, 3198 Wilson St.; Anthony Romano, 3200 Wilson St., both of Hollywood, Fla. 33021

[21] Appl. No.: 650,511

[22] Filed: Jan. 19, 1976

[51] Int. Cl.[2] ..... A47C 29/00

[52] U.S. Cl. ..... 135/5.3; 5/97; 16/147; 292/87; 292/258

[58] Field of Search ..... 220/324, 326; 135/5.1, 135/5 E, 7.1 R, DIG. 1, 5.2, 5.3, 6; 5/97, 113, 362; 292/87, 258, DIG. 50; 16/147

[56] References Cited

U.S. PATENT DOCUMENTS

| | | | |
|---|---|---|---|
| 728,483 | 5/1903 | Mahoney | 5/97 X |
| 810,788 | 1/1906 | Moseley | 135/5 E |
| 1,087,806 | 2/1914 | Miller | 135/DIG. 1 |
| 1,126,236 | 1/1915 | Lees | 135/DIG. 1 |
| 1,134,009 | 3/1915 | Reid | 135/5.1 |
| 1,462,657 | 7/1923 | Rainalter | 5/97 X |
| 1,874,998 | 8/1932 | Hiering | 292/DIG. 50 |
| 2,530,728 | 11/1950 | Ream | 5/97 |
| 2,930,387 | 3/1960 | Streich et al. | 135/6 X |
| 3,711,140 | 1/1973 | Onori | 292/87 |
| 3,822,905 | 7/1974 | Bell | 292/87 |

*Primary Examiner*—Werner H. Schroeder
*Assistant Examiner*—Conrad L. Berman
*Attorney, Agent, or Firm*—Allen D. Brufsky

[57] ABSTRACT

A canopy apparatus is provided for use in combination with a conventional child's crib. The canopy apparatus comprises a frame including a plurality of sides, a plurality of support members interconnecting two of said plurality of sides and a cover secured to the frame and supported by the support members. The canopy is mounted on and secured to an upper rail of one side wall of the crib by at least one pivot clamp and may be retained in a closed position over the crib by at least one retaining clamp.

9 Claims, 3 Drawing Figures

REMOVABLE CRIB CANOPY

BACKGROUND OF THE INVENTION

The present invention relates broadly to a canopy apparatus for use in combination with a conventional child's crib and, more particularly, the present invention is directed to a removable crib canopy which is adapted to be mounted on and releasably secured to a conventional child's crib without requiry of any special hardware having to be permanently affixed to the crib.

It will be appreciated that the present invention offers a relatively simple and inexpensive canopy which may be easily mounted on and secured to such cribs in order to prevent the child from climbing out of the crib and risking injury from a possible fall. Similarly, when the canopy of the present invention is so secured and placed in a closed position, it will insure that the child in the crib is protected from entry by, for example, household pets. Further, in certain instances when the cover of the canopy is so adapted, the canopy, when placed in a closed or partially closed position, may be used as a sun or wind shield. It is additionally contemplated that the canopy apparatus of the present invention may be readily opened and closed and, when in a closed position, be retained in such a position and, when necessary or desired, the canopy may be so locked in this closed position.

Numerous attempts have been made in the past to provide such a canopy apparatus and, in particular, one which could be releasably mounted on the crib and yet still be easily opened and closed. Such attempts include, for example, canopys or netting which were merely fitted over the crib such as, for example, the canopy described in U.S. Pat. No. 3,145,396. Additionally, zipper-like attachments were tried as in U.S. Pat. No.2,586,247 and pin mounted canopys were used as in U.S. Pat. No. 1,878,958. Further, hinged canopy tops, which were permanently affixed to the side walls of the crib, were described in detail in U.S. Pat. No. 1,742,011 and 1,418,541.

Each of these prior art attempts all fail, in one way or another, to accomplish the objectives of the present invention.

Against the foregoing background, it is a primary objective of the present invention to provide a crib canopy which may be readily mounted on and releasably secured to a conventional child's crib.

It is another object of this invention to provide a crib canopy which can be mounted on and releasably secured to a conventional child's crib yet be easily opened and closed.

It is still another object of this invention to provide a crib canopy which may be mounted on and releasably secured to a conventional child's crib without having to be permanently affixed thereto.

SUMMARY OF THE INVENTION

To the accomplishment of the foregoing objects and advantages, the present invention briefly comprises a canopy apparatus for use in combination with a conventional child's crib. The canopy comprises a frame, preferably rectangular in shape including a plurality of sides, a plurality of support members interconnecting at least two of said sides and a cover secured to the sides of the frame and supported by the support members. The canopy is adapted to be mounted on the crib and secured thereto by at least one pivot clamp adapted to grip one side of the frame of the canopy and an upper rail of one side wall of the crib. The pivot clamp includes a U-shaped portion adapted to grip the upper rail of the side wall of the crib and a generally semicircular portion adapted to engage one side of the frame. At least one retaining clamp may be used to retain the canopy in a closed position. The retaining clamp includes a U-shaped portion adapted to grip the upper rail of an opposed side wall of the crib and a partially curved portion adapted to frictionally engage the opposite side of the frame. Pressure screws are provided to secure the at least one pivot clamp and the at least one retaining clamp to their respective side walls.

In an alternative embodiment, at least two sides of the frame and the support members are segmented which each of the segments being hingably interconnected to provide a collapsable canopy.

DESCRIPTION OF THE DRAWINGS

The foregoing and still other objects and advantages of the present invention will be more apparent from the following detailed description of the invention in connection with the accompanying drawings wherein.

DESCRIPTION OF THE PREFERRED EMBODIMENTS

Figure 1:
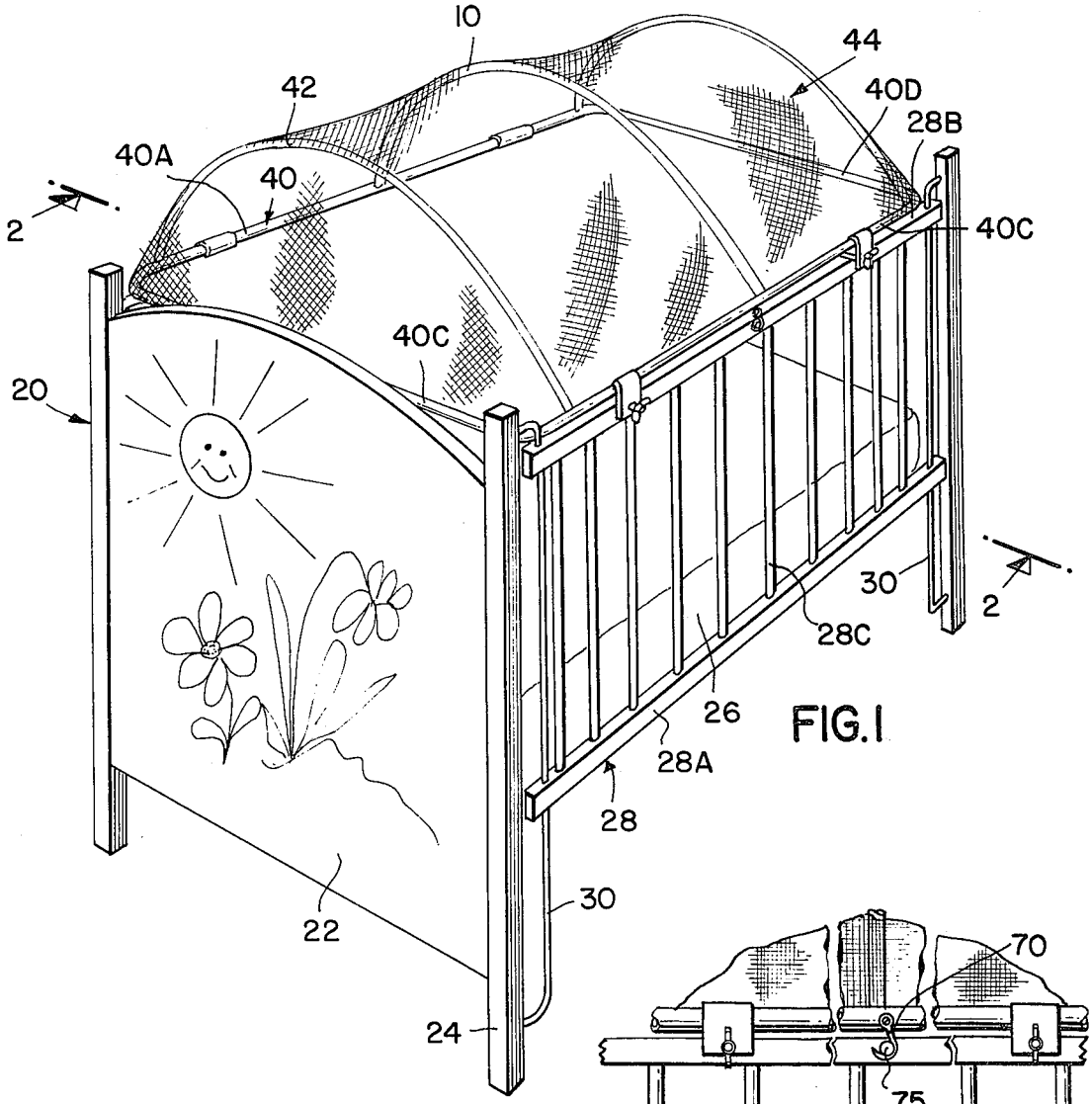
FIG. 1 is a perspective view of a conventional child's crib with the canopy of the present invention mounted on and secured thereto.

Referring now to FIG. 1 there is shown the canopy apparatus 10 of the present invention as it is mounted on and secured in a closed position to a conventional child's crib 20 which includes two opposed end panels 22, a plurality of legs 24, and a mattress 26. The end panels 22 are interconnected by a pair of opposed side walls 28 which include, in parallel alignment, upper and lower rails 28A and 28B, respectively, which are connected by a plurality of perpendicular slats 28C. The height of at least one of the side walls 28 may be adjusted relative to the end panels 22, by upward or downward movement along adjacent tracks 30 which are affixed to the adjacent legs 24.

The canopy apparatus 10 shown in FIG. 1 includes a frame 40 including a plurality of interconnecting sides, support members 42 and a cover 44. While the frame 40 may assume virtually any shape, due to the generally rectangular shape of cribs, it is preferred that the frame be rectangular in shape with four perpendicular sides. A plurality of support members 42 are positioned between two opposed sides of the frame. A preferred number of support members is three and it is preferred that the support members 42 assume an arcuate shape. The frame 40 and the support members 42 are preferably constructed from a tubular material. A particularly preferred material is aluminum tubing due to its high strength per weight ratio and availability. The cover 44 is preferably a mesh-like material such as, for example, a vinyl or a polypropylene netting. The cover 44 may, however, be solid sheet like material when it is intended to function as a sun or wind shield for the crib. In any event, the cover 44 is stretched over the support members 42 and secured to the sides of the frame 40.

It will be appreciated, of course, that the support members 42 and the two sides of the frame 40 which are parallel to the support members 42 may be segmented with each of the segments being hinged together in such a manner that the canopy apparatus may, when removed from the crib, be collapsed for easy storage.

Figure 2:
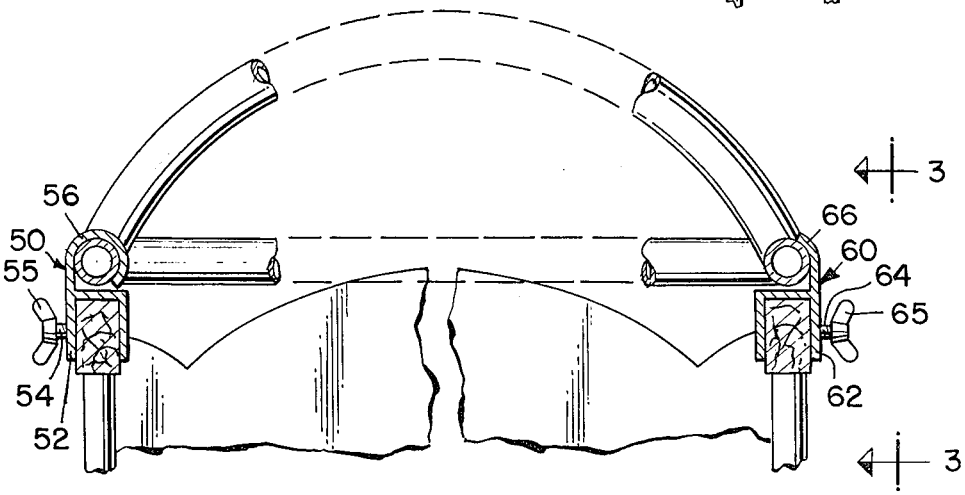
FIG. 2 is a sectional view taken along line 2—2 of FIG. 1.

The canopy apparatus should be of such dimensions as to fit over a conventional crib between the end panels 22 thereof with two opposed sides of the frame 40 resting on in juxtaposition the upper surface of the upper rails 28A of the two opposed side walls 28 of the crib. One opposed side of the frame 40 is secured to the upper rail 28A of one of the opposed side walls 28 by at least one pivot clamp 50 as shown in FIG. 2. Pivot clamp 50 included a generally U-shaped portion 52 adapted to receive upper rail 28A and be secured thereto by means of pressure screw 54 and wing nut 55. Pivot clamp 50 further includes a generally semi-circular portion 56 oppositely disposed from the generally U-shaped portion 52, said generally semi-circular portion 56 adapted to accept within and pivotably engage the opposed side of the frame 40. In this manner, the canopy apparatus, when secured to the crib, may easily be opened and closed by pivoting the canopy about this clamp. While virtually any number of pivot clamps 50 may be used, a preferred number is two positioned at opposite ends of the upper rail 28A

At least one retaining clamp 60 may be used to retain the opposite side of the frame in a closed position against the opposite side wall 28. The retaining clamp 60 has a generally U-shaped portion 62 adapted to receive the upper rail 28A of the opposite wall 28 and be secured thereto by means of a pressure screw 64 and a wing nut 65. The retaining clamp 60 further includes a partially rounded portion 66 oppositely disposed from the generally U-shaped portion 62, said partially rounded portion 66 adapted to frictionally engage the opposite side of the frame 40 when the canopy apparatus 10 is in a closed position over the crib, thus retaining the canopy apparatus in such a closed position. A preferred number of retaining clamps is two positioned at opposite ends of the upper rail 28A.

Figure 3:
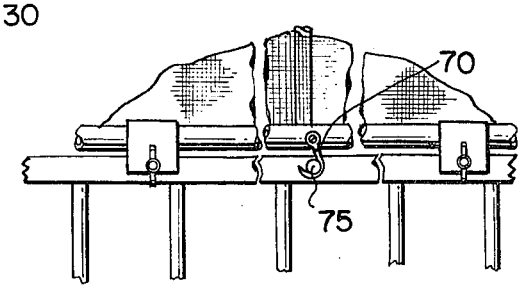
FIG. 3 is a fragmentary view taken along line 3—13 3 of FIG. 2.

The canopy apparatus 10 may be locked in a closed position over the crib 20 by engaging a hook 70 included on the opposite side of the frame 40 with a pin 75 correspondingly positioned on the upper rail 28A of the opposite side wall 28 of the crib as shown in FIG. 3.

It will, of course, be appreciated that the canopy apparatus 10 of the present invention may be quickly mounted on crib 20 by positioning the canopy over the crib, securing the at least one pivot clamp 50 to the upper rail 28A of one side wall 28 of the crib and engaging one side of the frame 40 within the semi-circular portion 56 of the clamp 50. The pivot clamp 50 is then secured to the crib 10 by tightening the pressure screw 54 by using wing-nut 55. The at least one retaining clamp 60 is similarly attached and secured to the upper rail 28A of the opposite side wall 28 of the crib 10 and will retain the canopy 10 in a closed position. The canopy 10 may be easily removed by loosening the pressure screws 54 and 64 and by lifting the canopy 10 off the crib.

Having thus described the invention with particular reference to the preferred forms thereof, it will be obvious that various changes and modifications may be made therein without departing from the spirit and scope of the invention as defined in the appended claims.

Wherefore we claim:

1. Canopy apparatus for use in combination with a conventional child's crib, said apparatus comprising a frame including a plurality of support members interconnecting any two of said plurality of sides and a cover affixed to said sides and supported by said support members, said apparatus adapted to be mounted on and releasable secured to said crib by at least one pivot clamp, said pivot clamp including a generally U-shaped portion oppositely disposed from a generally semi-circular portion, said generally U-shaped portion adapted to grip on upper rail of one of a pair of opposed side walls of the crib and said generally semi-circular portion adapted to pivotally engage over one of said plurality of tubular sides of the frame, the portion of said tubular side being engaged by said semicircular portion capable of journaling therein along the longitudinal axis thereof.

2. The apparatus of claim 1 wherein said pivot clamp includes means for releasably securing said clamp to said upper rail.

3. The apparatus of claim 2 wherein said means for releasably securing comprises a pressure screw.

4. The apparatus of claim 1 wherein said frame is rectangularly shaped including four sides and wherein said support members extend between any two opposed sides and support a mesh-like cover.

5. The apparatus of claim 4 wherein said support members are arcuately shaped.

6. The apparatus of claim 1 further including at least one retaining clamp, said retaining clamp comprising a generally U-shaped portion oppositely disposed from a partially curved portion, said generally U-shaped portion adapted to grip an upper rail of said opposite side wall of said crib and said partially curved portion adapted to frictionally engage one of said plurality of tubular sides of said frame so as to retain said canopy apparatus in a closed position over said crib.

7. The apparatus of claim 6 wherein said retaining clamp includes means of releasably securing said clamp to said upper rail.

8. The apparatus of claim 7 further including means of locking said canopy apparatus to said crib in a closed position.

9. The apparatus of claim 1 wherein said frame and said support members are fabricated from aluminum tubing.

* * * * *